US005975916A

United States Patent [19]

Okura

[11] Patent Number: 5,975,916

[45] Date of Patent: Nov. 2, 1999

[54] LOW PROFILE ELECTRICAL CONNECTOR ASSEMBLY

[75] Inventor: Kenji Okura, Hisai, Japan

[73] Assignee: Matsushita Electric Works, Ltd., Osaka, Japan

[21] Appl. No.: 08/978,378

[22] Filed: Nov. 25, 1997

[30] Foreign Application Priority Data

Nov. 26, 1996 [JP] Japan ..... P08-315347

[51] Int. Cl.[6] ..... H01R 9/09

[52] U.S. Cl. ..... 439/74; 439/660

[58] Field of Search ..... 439/74, 660, 295, 439/284

[56] References Cited

U.S. PATENT DOCUMENTS

| | | | |
|---|---|---|---|
| 4,934,944 | 6/1990 | Kozel et al. | 439/74 |
| 4,971,575 | 11/1990 | Martellotti | 439/284 |
| 5,161,985 | 11/1992 | Ramsey | 439/284 |
| 5,520,545 | 5/1996 | Sipe | 439/295 |
| 5,599,192 | 2/1997 | Olson | 439/660 |
| 5,626,482 | 5/1997 | Chan et al. | 439/74 |
| 5,626,500 | 5/1997 | Yoshimura | 439/74 |
| 5,836,773 | 11/1998 | McHugh et al. | 439/74 |

*Primary Examiner*—Edgar Burr
*Assistant Examiner*—Amanda B. Sandusky
*Attorney, Agent, or Firm*—Nikaido, Marmelstein, Murray & Oram LLP

[57] ABSTRACT

A lowered profile electrical connector assembly is composed of a socket and a detachable plug. A flat dielectric socket base mounts a plurality of arrayed first terminals each having a first spring contact. A dielectric plug base mounts a plurality of arrayed second terminals each having a second spring contact. Each first terminal includes a first lead which extends outwardly from a bottom of the socket base for electrical connection with an external circuit. The first and second terminals are each provided with first and second leads for electrical connection with external circuits. Each first terminal is shaped to have a S-shaped section composed of inverted and upright U-shaped portions which are continuous with one leg of the upright U-shaped portion shared by the inverted U-shaped portion. The upright U-shaped portion includes a free spring leg which defines the first spring contact having a free contact end for engagement with the second spring contact. Also, each second terminal includes a U-shaped portion having one leg which defines the second spring contact. With the provision of the S-shaped, i.e., the double U-shaped portions, the first spring contact can engage at its free end with the free end of the second spring contact. Therefore, the U-shaped portions of both the first and second terminals can be best utilized to develop a sufficient contacting pressure for reliable electrical contact within a low profile structure of the assembly.

8 Claims, 5 Drawing Sheets

LOW PROFILE ELECTRICAL CONNECTOR ASSEMBLY

BACKGROUND OF THE INVENTION

1. Field of the Invention

The present invention is directed to a low profile electrical connector assembly, and more particularly to a combination of surface mountable socket and plug.

2. Description of the Prior Art

U.S. Pat. No. 5,626,482 discloses a surface mountable electrical connector composed of a socket with a plurality of first terminals and a plug with a plurality of second terminals for mating contact with the first terminals. Each of the first terminals has a U-shaped portion to provide a first spring contact end at one of opposed legs of the U-shaped portion. While, each of the second terminal is shaped to have a rather straight contact end for pressed contact with the first spring contact end. The structure relies upon the spring force substantially only from a resilient deformation of the U-shaped portion on the side of the first terminal to achieve the pressed contact. In order to maintain a reliable contact between the terminals with this structure, it is necessary to make the U-shaped portion develop a considerably large spring bias. In this consequence, however, the structure requires a correspondingly large operating force to insert or remove the plug into and from the socket against the spring bias of the U-shaped portion for electrical engagement and disengagement between the first and second terminals. Otherwise, poor electrical contact would result. Further, the straight contact end of the second terminal is required to be held to a dielectric plug base over a long length so as to be firmly fixed thereto, thereby add an extra height to the plug and therefore the assembly of the plug and the socket, which is a hindrance to achieving a low profile design of the assembly.

Although not relating to the structure of the contact terminals, the above-mentioned patent discloses a structure of detachably connecting the plug and the socket with the use of two complementary U-shaped spring members fixed respectively to the socket and the plug. These two U-shaped members are incorporated to hold the plug and socket in mated condition and are therefore provided with no terminal lead for electrical connection with electrical circuits of printed board on which the socket and plug are mounted. Thus, the two U-shaped members are positioned without considering the effect of achieving a suitable contacting pressure and an arrangement of the terminal leads. Even if the two U-shaped spring members would be utilized to the first and second terminals, i.e., the straight contact end of the second terminal is modified to have the U-shaped portion, while keeping the terminal leads of the first and second terminals in suitable positions for the surface mounting, it would be necessary to orient the two U-shaped portion in the opposite directions in the assembled condition, as schematically shown in FIG. 1. However, such modified structure cannot permit to give a contact point at the interface between the free ends of the mating legs, and only permit to give the contact point away from the free end of one of the mating legs. With this result, substantially only one of the U-shaped portions is best utilized to give a spring bias for providing a contact pressure between the first and second spring contacts. Therefore, the modification is still insufficient in making the best use of the two U-shaped portions respectively of the first and second terminals to give a maximum contact pressure for reliable electrical connection between the first and second terminals.

SUMMARY OF THE INVENTION

The present invention has been achieved in view of the above insufficiencies to provide a fully lowered profile electrical connector assembly with maximum contacting pressure, particularly suitable for interconnection of closely packed printed boards.

The connector assembly in accordance with the present invention comprises a socket and a plug detachably connected to the socket. The socket has a flat dielectric socket base mounting a plurality of arrayed first terminals each having a first spring contact. The socket base is formed with a recess along a periphery of which the first spring contacts are arranged. A bank projects along the periphery of the recess from a bottom of the socket base so as to define a maximum height of the socket and is formed with a plurality of vertical slots each for mounting each of is the first terminals. The plug includes a dielectric plug base mounting a plurality of arrayed second terminals each having a second spring contact. Each first terminal includes a first lead which extends outwardly from a bottom of the socket base for electrical connection with an external circuit. The plug base is formed with a tenon which is to be inserted into the recess of the socket base and along a periphery of which the second spring contacts are arranged for contact engagement with the first spring contacts. The tenon is formed with a plurality of vertical slots for mounting the second terminals. Each second terminal includes a second lead which extends outwardly from a bottom of the plug base for electrical connection with an external circuit.

The important feature of the present invention resides in that each of the first terminals is shaped to have a generally S-shaped section comprising an inverted U-shaped portion and an upright U-shaped portion. The upright U-shaped portion has one leg common to the inverted U-shaped portion so that the upright U-shaped portion is continuous from the inverted U-shaped portion. The upright U-shaped portion includes a free spring leg which is opposed to the common leg and defines the first spring contact having a free contact end for contacting engagement with the second spring contact. The first lead extends from the lower end of the inverted U-shaped portion of the first terminal. Also, each second terminal is shaped to include a U-shaped portion having one leg which defines the second spring contact. The second lead extends from the U-shaped portion at a portion opposite from the second spring contact.

Since the first terminal is shaped to have the S-shaped section, i.e., the double U-shaped portions, the first spring contact of the upright U-shaped portion can engage at its free end with the free end of the second spring contact also of the U-shaped portion of the second terminal. Thus, the U-shaped portions of both of the first and second terminals are arranged in parallel and in the same direction and therefore can be best utilized to develop a sufficient contacting pressure for reliable electrical contact, while keeping the height of the assembly at a minimum and locating the first lead at the bottom of the socket body due to the presence of the inverted U-shaped portion. Further, because of that the U-shaped portions are arranged in parallel and in the same direction, the first spring contact can be kept engaged with the second spring contact over an elongated effective length so as to assure reliable electrical connection even with a relative movement of the plug to the socket.

Accordingly, it is a primary object of the present invention to provide a low profile electrical connector assembly which is capable of assuring a reliable electrical contact, yet minimizing the height of the assembly.

In a preferred embodiment, the S-shaped section of each first terminal is received in each vertical slot of the bank, and the socket base is formed with ribs each projecting within the vertical slot for engagement within the inverted U-shaped portion of the first terminal, thereby supporting the first terminal behind the upright U-shaped portion to allow the first spring contact to flex sufficiently for obtaining an optimal contact pressure. Therefore, it is another object of the present invention to provide a low profile electrical connector assembly which is capable of giving the optimal contact pressure from the upright U-shaped portion.

The inverted U-shaped portion has two legs at least one of which is formed on opposite edges thereof with a tab and a horn, respectively. The tab is inserted in a slit formed in one of the opposite walls of each vertical slot, while the horn is pressed against the other wall of the vertical slot. Thus, the first terminal can be easily and fixedly secured to the socket base to enhance assembly efficiency as well as accurate positioning of the first terminal, which is therefore a further object of the present invention.

The second spring contact is formed with a dent for latching engagement with the free contact end of the first spring contact for reliable electrical connection, which is therefore a still further object of the present invention.

DETAILED DESCRIPTION OF THE EMBODIMENT

Figure 1:
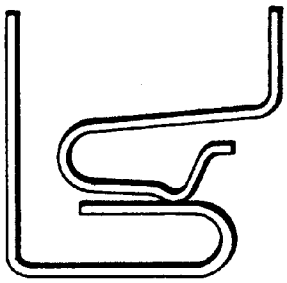
FIG. 1 is a schematic diagram illustrating a possible modification of a prior art.
Figure 2:
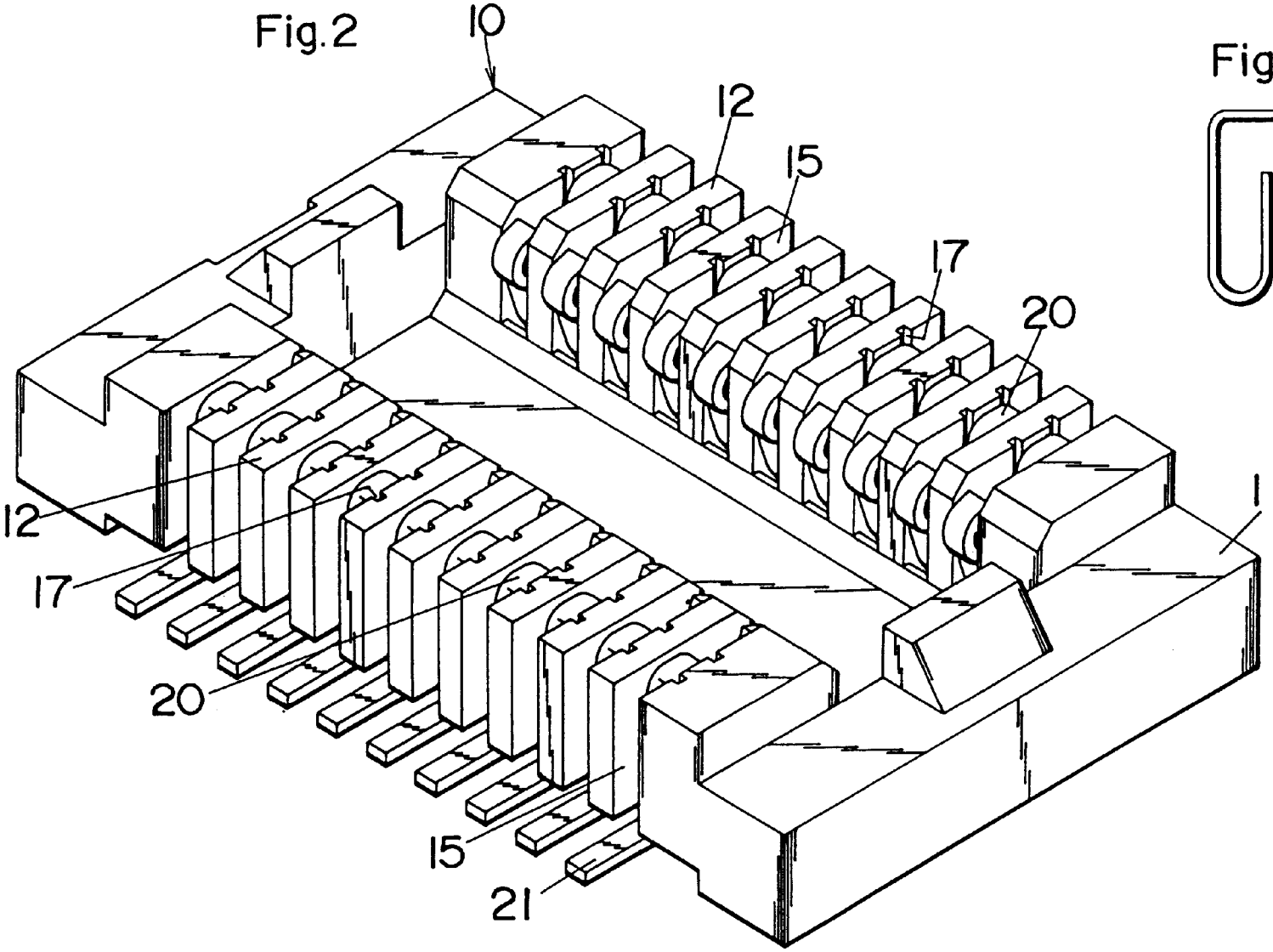
FIG. 2 is perspective view of a socket utilized in an electrical connector assembly in accordance with a preferred embodiment of the present invention.
Figure 3:
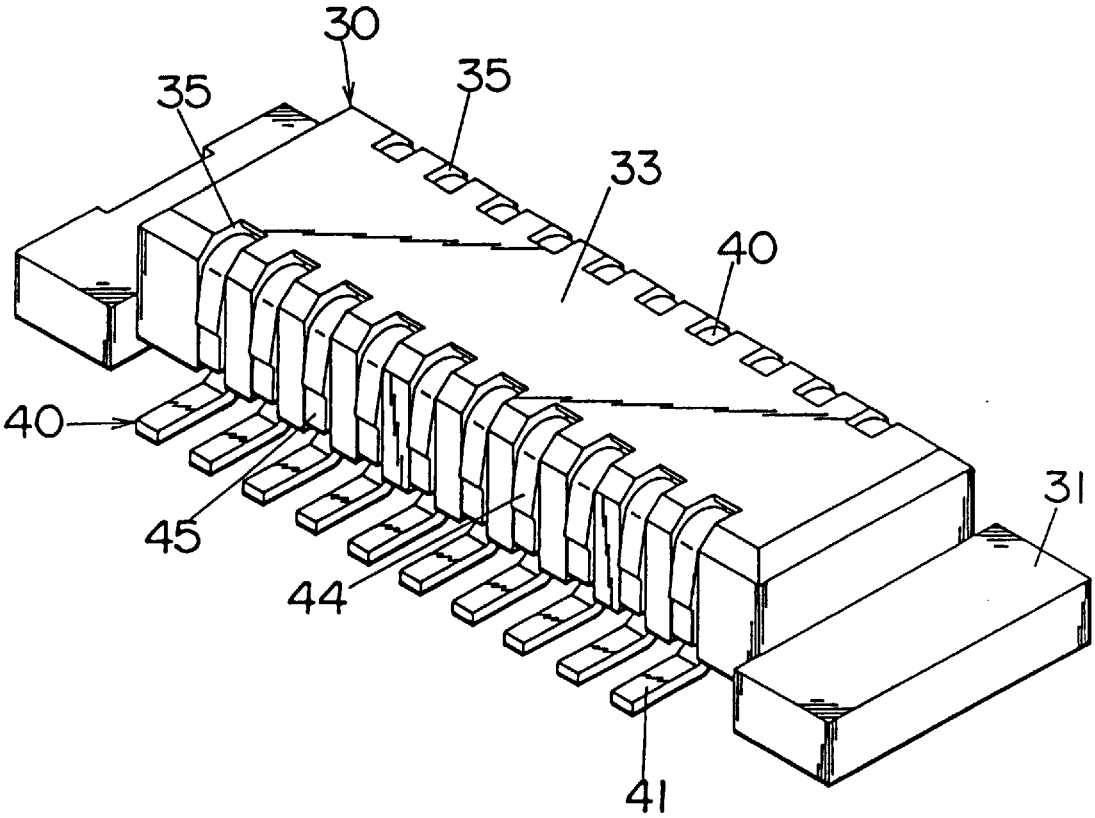
FIG. 3 is a perspective view of a plug utilized in the electrical connector.

Referring now to FIGS. 2 and 3, there is shown a low profile electrical connector assembly in accordance with a preferred embodiment of the present invention. The electrical connector is composed of a socket 10 and a plug 30 which are respectively of flat configurations for surface mounting on individual printed boards to interconnect electrical circuits on the printed boards.

Figure 4:
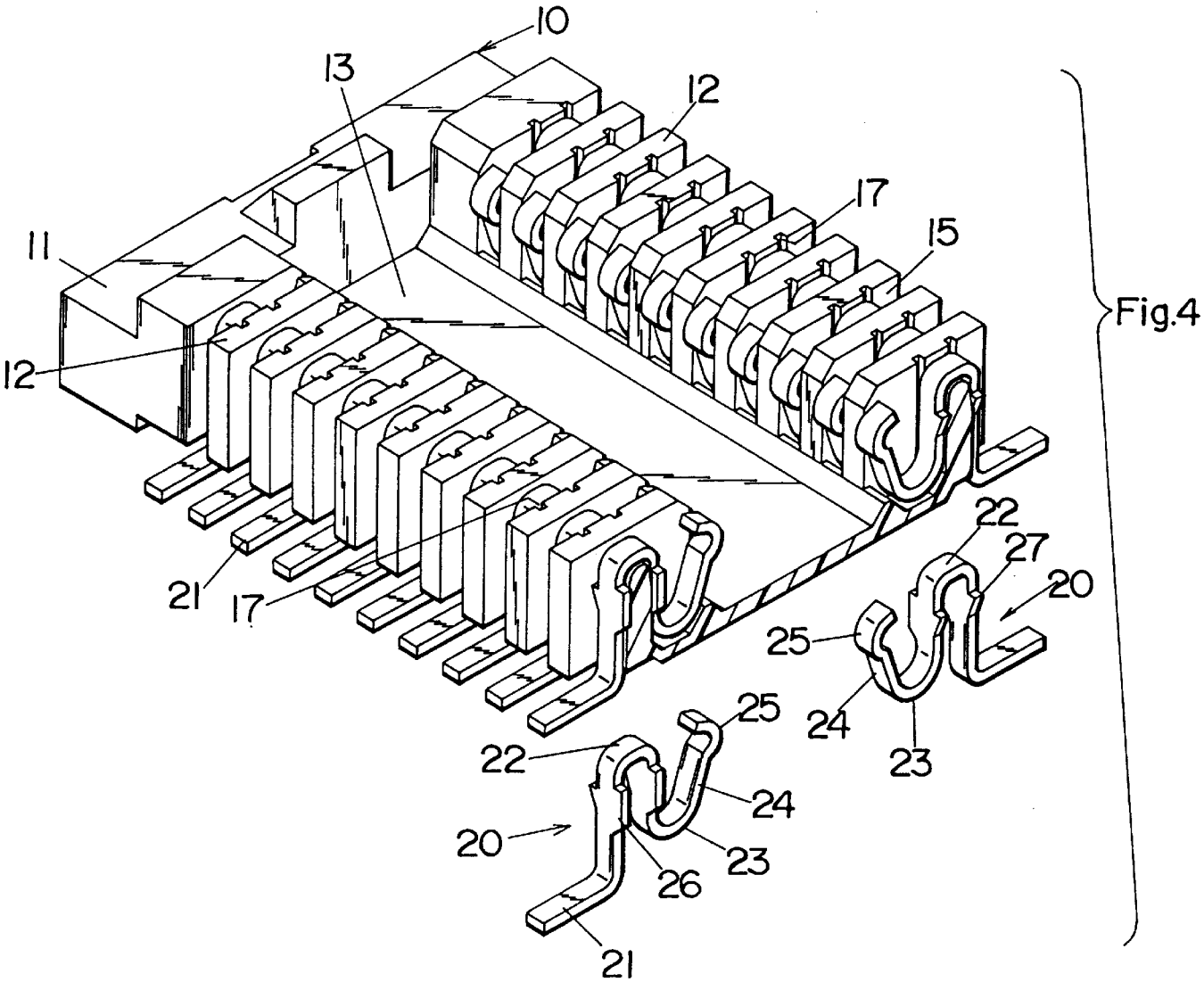
FIG. 4 is an exploded perspective view of the socket shown with a portion thereof cut away.

As shown in FIGS. 2 and 4, the socket 10 comprises a dielectric socket base 11 mounting a plurality of first terminals 20 in parallel arrays. The socket base 11 is of a flat rectangular configuration to have a flat bottom from which positioning studs (not shown) project. Projected on the opposite lateral sides of the socket base 11 are banks 12 which extend along the length of the base to define therebetween a recess 13 as well as define a height of the socket. Each bank 12 is formed with a plurality of evenly spaced vertical slots 15 respectively for holding the first terminals 20. A rib 16 integrally molded with the socket base 11 projects from the bottom of the base into each of the vertical slots 15 at a portion between the inner and outer ends of the bank 12.

Figure 6:
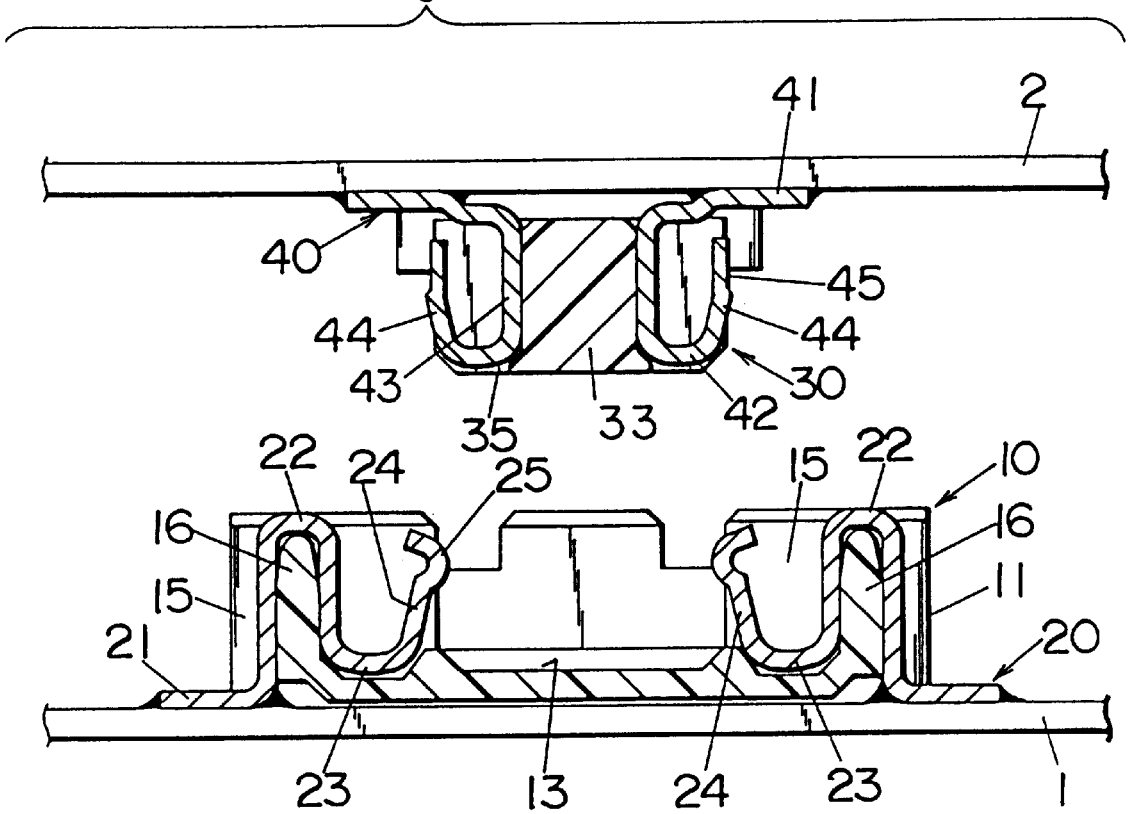
FIG. 6 is an exploded sectional view illustrating the assembly in a disconnected condition.

The first terminal 20 is a stamped metal strip which is shaped to have a generally S-shaped section and a first terminal lead 21. The S-shaped section is composed of an inverted U-shaped portion 22 with two opposed legs and an upright U-shaped portion 23 with two opposed legs one of which is common to the inverted U-shaped portion 23 and the other of which defines a first spring contact 24. The free end of the first spring contact 24 is bent to provide a first contact end 25. The first terminal lead 21 extends horizontally outwardly from the lower end of the leg of the inverted U-shaped portion 22. Each leg of the inverted U-shaped portion 22 is provided on its opposite edges with a tab 26 and a horn 27. The tab 26 made for insertion into a slit 17 formed in one of the opposite walls of each slot 15, while the horn 26 is for pressed abutment against the other wall of the slot 15. The first terminals 20 are thus press-fitted in the individual vertical slots 15 to have the first contact end 25 projecting into the recess 13 and the first terminal lead 21 extending horizontally from the bottom of the socket body 11 for soldering connection on the printed board 1, as shown in FIG. 6. The rib 16 in each slot 15 fits inside of the inverted U-shaped portion 22 to provides a back-up for the upright U-shaped portion 23, thereby allowing the first spring contact 24 to flex in a direction of narrowing the width of the upright U-shaped portion 23.

Figure 5:
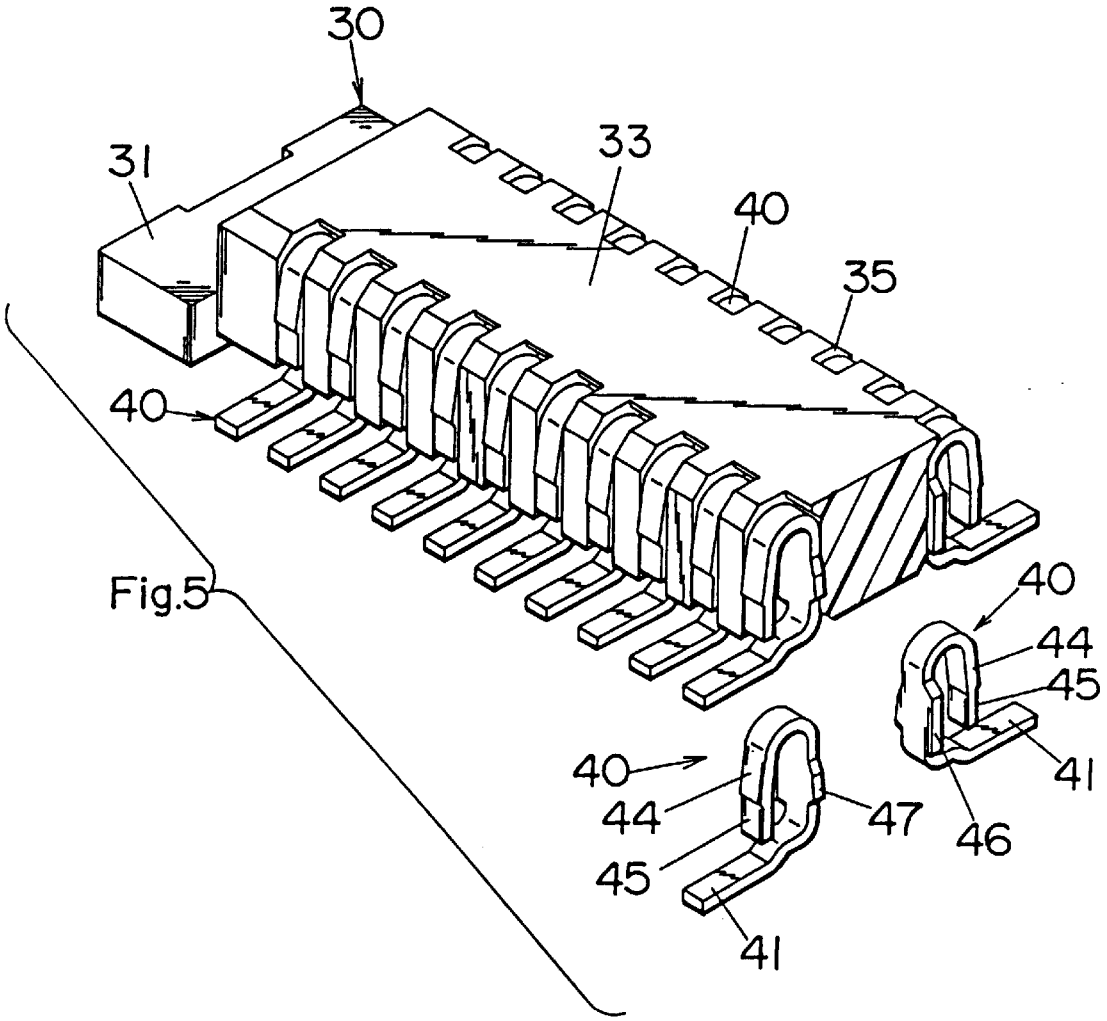
FIG. 5 is an exploded perspective view of the plug shown with a portion thereof cut away.

As shown in FIGS. 3 and 5, the plug 30 comprises a dielectric plug base 31 mounting a plurality of second terminals 40 arranged in two parallel arrays. The plug base 31 has a flat bottom with positioning studs (not shown) and includes an elongated tenon 33 projecting from the bottom for mating engagement into the recess 13 of the socket base 11. The tenon 33 is formed in its laterally opposed sides respectively with vertical slots 35 for fixedly mounting the second terminals 40.

Figure 7:
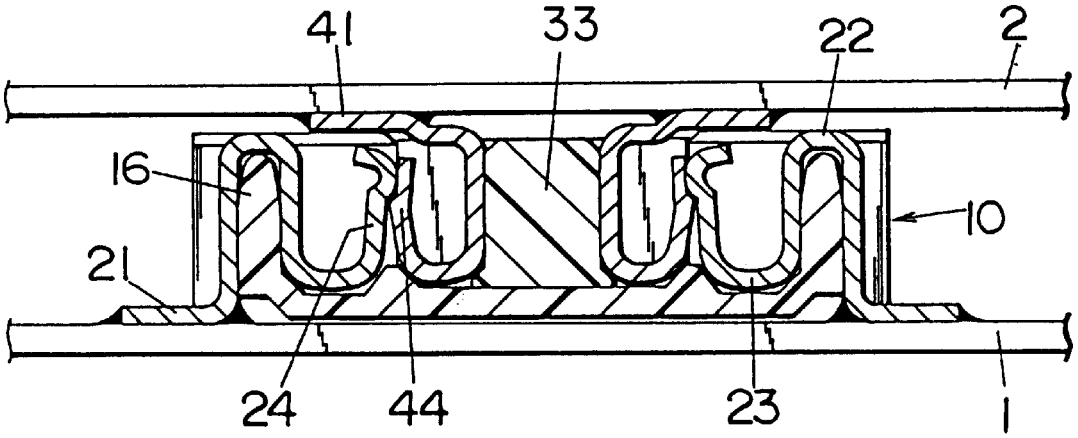
FIG. 7 is sectional view illustrating the assembly in a connected condition.

The second terminal 40 is also a stamped and formed metal strip which is shaped to have a U-shaped portion 42 with a pair of legs one of which defines a second spring contact 44 and the other of which defines a anchor leg 43 for fixed engagement with the tenon 33. A second terminal lead 41 is bent from the lower end of the anchor leg 43 and extends horizontally over the lower end of the second spring leg 44. Formed at the lower end of the second spring contact 44 is a dent 45 which serves as a second contact end for catching the first contact end 25 of the first terminal 20 to provide a latching engagement therebetween. The anchor leg 43 is provided on its opposite edges with a tab 46 and a horn 47, respectively for insertion into slit (not shown) formed in one of opposite walls of each slot 35 and for pressed abutment against the other wall of the slot 35. The second terminals 40 are thus press-fitted in the individual slots 35 to expose the second spring contact 44 to the exterior of the tenon 33 and to extend the second terminal lead 41 horizontally from the bottom of the plug base 31 for surface mounting, i.e., soldering connection to the printed board 2, as shown in FIG. 6. The U-shaped portion 42 is held in position with the anchor leg 43 supported by the tenon 33 so that the second spring contact 44 is allowed to flex inwardly when engaging the first spring contacts 24, as shown in FIG. 7.

When inserting the tenon 33 of the plug 30 into the recess 13 of the socket 10, the first and second spring contacts 24 and 44 are both caused to flex inwardly so as to correspondingly develop individual spring biases which are cooperative to give a sufficient contact pressure at a contact point between the first and second contact ends 25 and 45. Thus, the first and second terminals 20 and 40 are kept electrically connected stably and reliably at such sufficient contacting pressure to minimize electrical resistance therebetween. As shown in FIG. 7, since the first contact end 25 in the form of a projection engages into the second contact end 45 in the form of the dent, they are latched to keep the first and second terminals closed stably.

What is claimed is:

1. A low profile electrical connector assembly which comprises:

a socket having a flat dielectric socket base mounting a plurality of arrayed first terminals each having a first spring contact, a plug having a dielectric plug base mounting a plurality of arrayed second terminals each having a second spring contact, said second spring contacts being arranged for contact engagement with said first spring contacts when said plug mates with said socket;

each said first terminal including a first lead which extends outwardly from a bottom of said socket base for electrical connection with an external circuit;

each said second terminal including a second lead which extends outwardly from a bottom of said plug base for electrical connection with an external circuit;

wherein each of said first terminals is shaped to have a generally S-shaped section comprising an inverted U-shaped portion and an upright U-shaped portion, said upright U-shaped portion having one leg common to said inverted U-shaped portion so that said upright U-shaped portion is continuous from said inverted U-shaped portion, said upright U-shaped portion including a free spring leg which is opposed to said common leg and defines said first spring contact having a free contact end at which said first spring contact is engaged with said second spring contact;

said first lead extending from the lower end of said inverted U-shaped portion of said first terminal; and each of said second terminals being shaped to include a U-shaped portion having one leg which defines said second spring contact; and said second lead extending from said U-shaped portion at a portion opposite from said second spring contact.

2. The low profile electrical connector assembly as set forth in claim 1, wherein one of said plug base and said socket base is formed with a tenon which mates into a recess formed in the other of said plug base and said socket base such that said first and second spring contacts are engaged on both sides of the tenon which is mated into the recess.

3. The low profile electrical connector assembly as set forth in claim 1, wherein said plug base is formed with a tenon which mates into a recess formed in said socket base, said first spring contacts being arranged along a periphery of said recess, said second spring contacts being arranged along a periphery of said tenon, said socket base being formed with a bank which projects along the periphery of said recess from a bottom of said socket base to define a maximum height of said socket, said bank being formed with a plurality of vertical slots each for mounting said first terminals, said tenon being formed with a plurality of vertical slots into each of which a major portion of said second terminal fits tightly.

4. The low profile electrical connector assembly as set forth in claim 3, wherein said S-shaped section of each said first terminal is received in each of said vertical slot of said bank and wherein said socket base is formed with ribs each projecting within each said slot for engagement within said inverted U-shaped portion of each said first terminal.

5. The low profile electrical connector assembly as set forth in claim 3, wherein said inverted U-shaped portion has two legs at least one of which is formed on opposite edges thereof with a tab and a horn, respectively, said tab being inserted in a slit formed in one of the opposite walls of each said vertical slot, and said horn being pressed against the other wall of said each slot.

6. The low profile electrical connector assembly as set forth in claim 3, wherein said U-shaped portion of each said second spring contact has two legs at least one of which is formed on opposite edges thereof with a tab and a horn, respectively, said tab being inserted in a slit formed in one of the opposite walls of each said vertical slot, and said horn being pressed against the other wall of said each slot.

7. The low profile electrical connector assembly as set forth in claim 1, wherein said free contact end of each said first spring contact is made for a latching engagement with a dent formed in said second spring contact.

8. A low profile electrical connector assembly which comprises:

a socket having a flat dielectric socket base mounting a plurality of arrayed first terminals each having a first spring contact;

a plug having a dielectric plug base mounting a plurality of arrayed second terminals each having a second spring contact, said second spring contacts being arranged for contact engagement with said first spring contacts when said plug mates with said socket;

each said first terminal including a first lead which extends outwardly from a bottom of said socket base for electrical connection with an external circuit;

each said second terminal including a second lead which extends outwardly from a bottom of said plug base for electrical connection with an external circuit;

wherein each of said first terminals is shaped to have a first U-shaped portion with a free spring leg which defines said first spring contact;

each of said second terminals is shaped to include a second U-shaped portion with a free spring leg which defines said second spring contact; and said first and second U-shaped portions are disposed, respectively in said socket and plug in such a manner that they are oriented in the same direction in a parallel relation to one another when said plug is mated with said socket, thereby causing said first and second spring contacts to be brought into contacting engagement with one another.

* * * * *